US011361626B2

(12) United States Patent
Calizaire

(10) Patent No.: US 11,361,626 B2
(45) Date of Patent: Jun. 14, 2022

(54) POCKETBALL BETTING

(71) Applicant: Clivantz Calizaire, Miaramar, FL (US)

(72) Inventor: Clivantz Calizaire, Miaramar, FL (US)

( * ) Notice: Subject to any disclaimer, the term of this patent is extended or adjusted under 35 U.S.C. 154(b) by 0 days.

(21) Appl. No.: 16/831,667

(22) Filed: Mar. 26, 2020

(65) Prior Publication Data

US 2021/0304568 A1 Sep. 30, 2021
US 2022/0130212 A9 Apr. 28, 2022

Related U.S. Application Data

(60) Provisional application No. 62/919,740, filed on Mar. 27, 2019.

(51) Int. Cl.
*G07F 17/32* (2006.01)

(52) U.S. Cl.
CPC ..... *G07F 17/3288* (2013.01); *G07F 17/3241* (2013.01)

(58) Field of Classification Search
CPC ..... G07F 17/3244; G07F 17/3288; G07F 17/3241; G07F 17/326
See application file for complete search history.

(56) References Cited

U.S. PATENT DOCUMENTS

2006/0287094 A1* 12/2006 Mahaffey ..... G07F 17/32 463/42
2008/0113816 A1* 5/2008 Mahaffey ..... G07F 17/3288 463/42
2014/0342817 A1* 11/2014 Marantelli ..... A63F 13/00 463/28
2015/0018082 A1* 1/2015 Kim ..... A63F 13/35 463/25
2017/0140611 A1* 5/2017 Marantelli ..... G07F 17/3237
2018/0047254 A1* 2/2018 Acton ..... G06Q 50/34

* cited by examiner

*Primary Examiner* — Steve Rowland
(74) *Attorney, Agent, or Firm* — Mark C. Johnson; Johnson Dalal

(57) ABSTRACT

An algorithmic-based gaming method implemented through a computing system and including generating, with a computer processor, a finite set of 100 temporal elements corresponding to minutes of a prospective soccer match, dividing the finite set of 100 temporal elements into divided and equal quotient betting sections each uniquely including at least one of the 100 temporal elements, the equal quotient betting sections corresponding to a user winning outcome, receiving a plurality of temporal element selections from a plurality of users communicatively coupled to the computing database, and producing a random winning outcome from the occurrence of the prospective soccer match, the random winning outcome corresponding to a last goal scored in the occurrence of the prospective soccer match and the one of the plurality of temporal element selections received from the plurality of users and stored on the computing database.

2 Claims, 6 Drawing Sheets

POCKETBALL BETTING

CROSS-REFERENCE TO RELATED APPLICATIONS

The applicant is claiming the benefit for the Pocketball Betting.

BACKGROUND OF THE INVENTION

1. Field of the Invention

The invention relates to the field of sports betting. More particularly, a method that incorporates randomness into sports betting to prevent match-fixing from generating an expected gain.

2. Description of the Related Art

Sports betting is one of the most popular forms of entertainment played among sports fans. It allows people to have a great time and fully enjoy the beauty of athletic competitions. Sports betting increases fans' interest in sport competitions and the enjoyment received creates interaction and engagement among them.

Traditionally, a bet is a binary wager for two players to play one against another. Currently, one of the problems of the sports betting method is that it allows players to bet directly on the outcomes of sport competitions, which can be easily influenced by athletes or match officials. Wagering on the outcome of a match requires bettors to predict the team that will either win or lose. The biggest problem of betting directly on the outcome of sport competitions is that it creates a situation of cause and effect. If you can manipulate the results of an athletic contest, then the logic would follow that you can also manipulate the outcome of sports wagering as well. Thus, the integrity of both sport and sports betting is vulnerable because the results of sport competitions determine the wagering outcome.

Since match-fixing revolves around the results of sport competitions, corrupted gamblers bribe athletes or referees to control the results of sport competitions. Then, they reliably place bets on the arranged outcome and are guaranteed an expected gain. Such a fraud is called match-fixing. According to the Council of Europe, also known as the Macolin Convention, which is the Convention of European countries on the Manipulation of Sport Competition, "Match-fixing is the manipulation of sport competitions means an intentional arrangement, act or omission aimed at an improper alteration of the result or the course of a sport competition in order to remove all or part of the unpredictable nature of the aforementioned sport competition with view to obtaining an undue advantage for oneself or for others."

During the last decade, the integrity of sports has been confronted with an increasing number of scandals linked to match-fixing. When this kind of fraud happens, athletes and referees risk jail time, corruptors make a profit without any financial risk; bettors are cheated; sports fans and spectators lose interest in the league and look for an alternative entertainment; and finally, bookmakers lose money, which may eventually drive them out of business. Provide a method that makes match-fixing irrelevant is the focus of the present invention.

As a consequence of the foregoing situation, the integrity of sports is threatened. Thus, there is a need to provide a novel method to: a) prevent match-fixing from generating an expected gain, b) offer an equal chance of winning to each participant, c) randomly select a winner among all participants, d) to provide a plethora of betting products. The stipulation of those methods is the object of the present invention.

The present invention provides a method for solving the problem of match-fixing for betting purpose. Pocketball is a process that generates an outcome at random from a football match. The model is a new betting method in which you play on a sporting event rather than wagering on the victory of a team, which is often fixed. The concept is to convert the game of football into a random number generator to protect the integrity of sport from the threat of match-fixing. Pocketball is a prognostic contest in which different players compete against each other to see who is the most efficient at predicting a "random outcome" drawn from the sporting event in question. The game is designed to prevent athletes and match officials from manipulating the outcome of sport competitions. One of the advantages of Pocketball game is that players may use their rationality to maximize their chance of winning or increase the potential payout by choosing the odds that are in their best interest. Pocketball aims to preserve integrity of both sport and sports betting by making match-fixing unable to guarantee an expected gain. The method is applicable to different sports disciplines, such as soccer, American football, basketball, baseball, hockey, volleyball and tennis, water polo, cricket and rugby.

Prior art regarding a betting method in which bettors don't take a side like Over/Under. Over/Under betting is a wager in which bettors simply choose whether the total number of points scored by both teams will be over or under a total of points provided by a bookmaker. Prior art regarding another betting method in which bettors don't bet on any particular team like Odd or Even goals betting. Odd or Even goals betting is where bettors bet on if the amount of goals that a soccer game produces is an even or odd number, simply by adding them together. However, neither Over/Under nor Odd or Even goals doesn't attempt to preserve the integrity of sports. The Pocketball is a wager in which participants select a combination and hope to match a winning number randomly generated from the sporting event. At the conclusion of the sporting event, participants who have the "winning or generated number" listed in their selected combinations win. Otherwise, they lose. The Pocketball betting is a new proprietary and patentable wagering method which has no precedent and does not infringe any existing prior art.

SUMMARY

The present invention provides a method that goes against the concept of match-fixing. The Pocketball betting has been developed in response to the problem of match-fixing that has not yet been solved by current betting methods. This summary is provided to introduce the Pocketball in a simplified form that is further described in the detailed description. This Summary is intended neither to identify key or essential features, nor to limit the scope, of the invention.

A unique aspect of the present invention is that it provides a method that prevents match-fixing from generating an expected gain.

A distinctive aspect of the present invention is that it provides an equal chance of winning to each participant.

Another distinctive aspect of the present invention is that it provides a method to randomly select a winner among all participants.

An advantage of the present invention is that it provides a plethora of betting products.

In the following description, reference is made to the accompanying drawings which form a part hereof, and in which are shown, by way of illustration, specific example implementations of this technique. It is understood that other changes may be made without departing from the scope of the disclosure.

DESCRIPTION OF THE DRAWINGS

The illustrated invention in the FIGS. 1 to 3 of the accompanying drawings which are meant to be exemplary and not limiting, in which like references are intended to refer to like or corresponding parts, and in which.

DETAILED DESCRIPTION OF THE INVENTION

Figure 1:
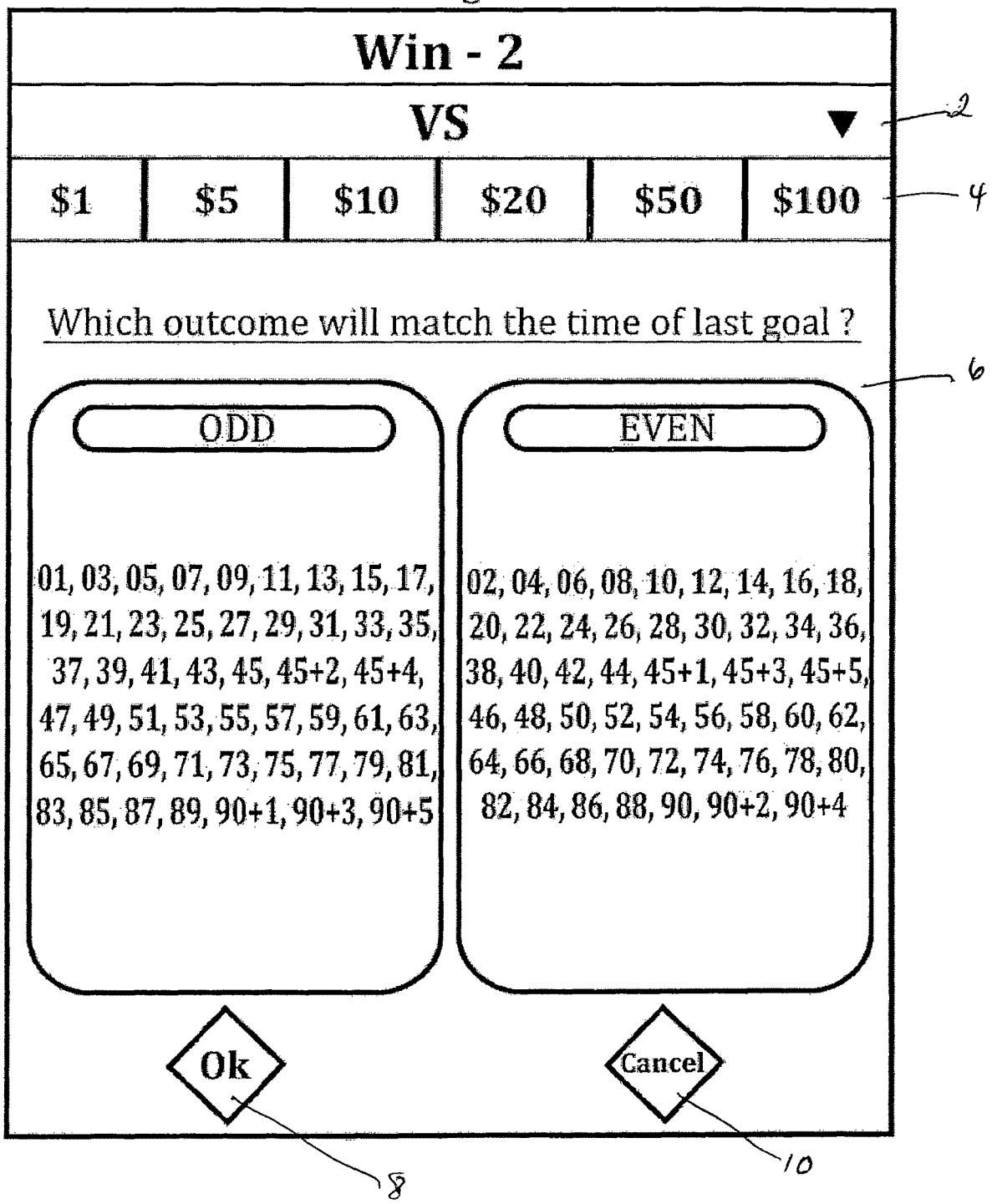
FIG. 1 is an illustration of Win-2 bet, a wager that has two equally likely possible outcomes for two contestants to play against one another, as it would be viewed and used by the participants accordingly to the embodiment of the present invention.

The Pocketball betting method will now be described more fully hereinafter with reference to the accompanying drawings, which form a part hereof, and which show, by way of illustration, exemplary embodiments in which the invention may be practiced. The Pocketball betting method may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. The following detailed description is, therefore, not intended to be taken in a limiting sense.

The version of Pocketball method applied to soccer is called Ultimate Goal. The Ultimate Goal is a prognostic contest in which different players compete against each other to see who is the most efficient at predicting a "random variable" drawn from the athletic contest. It is a player versus player game, and the house does not wager against its players. The Ultimate Goal is a game within a game where the score of the sporting event does not influence the wagering outcome. Soccer fans and spectators wager on a sporting event rather than betting on the outcome of sport, which is often the subject of result manipulation. The object of the game consists of selecting a group of 50-number or fewer in attempt to match a random outcome. The sport competition will produce a random outcome unpredictably. This number is going to match a correlated number in any of the possible outcomes. At the conclusion of the soccer match, participants who match the random outcome is the winner. For example, if you select a group of 50 numbers, in order for you to win, one of your 50 numbers must match the random outcome.

The theory of chance is articulated around two concepts, which complement each other. On the one hand, every participant must have an equal probability or chance of winning. On the other hand, the winners must be the result of a random draw.

Equal Probability—

The present invention provides a method to divide probability or chance of winning into n predictions, so that the choice of each participant is worth exactly 1/n. In a contest, if players do not have an equal chance of winning, some informed participants would have an unfair advantage over uninformed ones. To divide probability into equal predictions, we must have what we call a "numeric field." A "numeric field" is the set that has all the elements of an experiment or a random trial. To assemble the elements of the numeric field, we use the minute of a soccer match. A football match consists of the regulation time, which is 90-minute divided in two halves of 45-minute. The stoppage time is 10-minute (5×2), which is added at the end of halves by match officials. The aggregate stoppage time is composed of the following numbers 45+1, 45+2, 45+3, 45+4, 45+5, 90+1, 90+2, 90+3, 90+4, and 90+5. When we combine the regulation with the stoppage times, we have a finite set called the numeric field. By doing so, a correspondence is established, where each minute of a soccer match is paired with exactly a number of the numeric field. Below is the numeric field for the game of football/soccer.

$\Omega$

{01, 02, 03, 04, 05, 06, 07, 08, 09, 10,
11, 12, 13, 14, 15, 16, 17, 18, 19, 20,
21, 22, 23, 24, 25, 26, 27, 28, 29, 30,
31, 32, 33, 34, 35, 36, 37, 38, 39, 40,
41, 42, 43, 44, 45, 45+1, 45+2, 45+3, 45+4, 45+5
46, 47, 48, 49, 50, 51, 52, 53, 54, 55,
56, 57, 58, 59, 60, 61, 62, 63, 64, 65,
66, 67, 68, 69, 70, 71, 72, 73, 74, 75,
76, 77, 78, 79, 80, 81, 82, 83, 84, 85,
86, 87, 88, 89, 90, 90+1, 90+2, 90+3, 90+4, 90+5}

$\Omega$=a football match=100−element

To determine the number of equal possible outcomes are in the numeric field $\Omega$, we need to calculate factor of 100. Factor is the process of finding a number that can divide another number evenly or without a remainder. The number of equal predictions can be determined by dividing 100 by 2, 4, 5, 10, 20 and 25.

Win-2

The present invention provides a method to divide chance into two possibilities. Win-2 game is a binary bet for two players to wager against each other. Each player must have an equal probability of winning, which is 50-50 chance. To provide each contestant an equal chance, we divide $100 \div 2 = 50$, where 100, the dividend, is the total number of chances in the numeric field.

2, the divisor, is the total number of possible outcomes.

50, the quotient, is the number of elements in each possible outcome.

Then we use the arithmetic progression method to separate odd from even numbers. The following sequence is an AP with common difference 2.

Odd Pocket: {01, 03, 05, 07, 09, 11, 13, 15, 17, 19, 21, 23, 25, 27, 29, 31, 33, 35, 37, 39, 41, 43, 45, 45+2, 45+4, 47, 49, 51, 53, 55, 57, 59, 61, 63, 65, 67, 69, 71, 73, 75, 77, 79, 81, 83, 85, 87, 89, 90+1, 90+3, 90+5}.

Even Pocket: {02, 04, 06, 08, 10, 12, 14, 16, 18, 20, 22, 24, 26, 28, 30, 32, 34, 36, 38, 40, 42, 44, 45+1, 45+3, 45+5, 46, 48, 50, 52, 54, 56, 58, 60, 62, 64, 66, 68, 70, 72, 74, 76, 78, 80, 82, 84, 86, 88, 90, 90+2, 90+4}.

In Win-2 game, there is a sample space that has two equally likely possible outcomes. Each possible outcome has a probability of 1/2, 0.5 or 50% chance. The athletic contest will produce a random variable that is going to match a correlated number in one of the two possible outcomes. Suppose you are asked, "In which pocket will the first goal occur?" Since both possible outcomes are equally likely, you would also be undecided on a favorable choice. When you play the Win-2 game, it is possible to win, but not certain.

Win-4

The present invention provides a method to divide chance into four possibilities. Win-4 game is a bet for four players to wager against each other. Each player must have an equal probability of winning, which is 25% chance. To provide each contestant an equal chance, we divide 100÷4=25, where 100, the dividend, is the total number of elements in the numeric field.

4, the divisor, is the total number of possible outcomes.

25, the quotient, is the number of elements in each prediction.

Then we use the arithmetic progression method. The following sequence is an AP with common difference 4.

♥={01, 05, 09, 13, 17, 21, 25, 29, 33, 37, 41, 45, 45+4, 49, 53, 57, 61, 65, 69, 73, 77, 81, 85, 89, 90+3}

♠={02, 06, 10, 14, 18, 22, 26, 30, 34, 38, 42, 45+1, 45+5, 48, 52, 56, 60, 64, 68, 72, 76, 80, 84, 88, 90+2}

♦={03, 07, 11, 15, 19, 23, 27, 31, 35, 39, 43, 45+2, 47, 51, 55, 59, 63, 67, 71, 75, 79, 83, 87, 90+1, 90+5}

♣={04, 08, 12, 16, 20, 24, 28, 32, 36, 40, 44, 45+3, 46, 50, 54, 58, 62, 66, 70, 74, 78, 82, 86, 90, 90+4}

In Win-4 game, there is a sample space that has four equally likely possible outcomes. Each possible outcome has a probability of 1/4, 0.25 or 25% chance. The athletic contest will produce a random variable that is going to match a correlated number in one of the two possible outcomes. Suppose you are asked, "In which pocket will the first goal occur?" Since all possible outcomes are equally likely, you would also be undecided on a favorable choice. When you play the Win-4 game, it is possible to win, but not certain.

Win-5

The present invention provides a method to divide chance into five possibilities. Win-5 game is a bet for five players to wager against each other. Each player must have an equal probability of winning, which is 25% chance. To provide each contestant an equal chance, we divide 100÷5=20, where 100, the dividend, is the total number of elements in the numeric field.

5, the divisor, is the total number of possible outcomes.

20, the quotient, is the number of elements in each prediction.

Then we use the arithmetic progression method. The following sequence is an AP with common difference 5.

A:{01, 06, 11, 16, 21, 26, 31, 36, 41, 45+1, 46, 51, 56, 61, 66, 71, 76, 81, 86, 90+1}

E:{02, 07, 12, 17, 22, 27, 32, 37, 42, 45+2, 47, 52, 57, 62, 67, 72, 77, 82, 87, 90+2}

I:{03, 08, 13, 18, 23, 28, 33, 38, 43, 45+3, 48, 53, 58, 63, 68, 73, 78, 83, 88, 90+3}

O:{04, 09, 14, 19, 24, 29, 34, 39, 44, 45+4, 49, 54, 59, 64, 69, 74, 79, 84, 89, 90+4}

U:{05, 10, 15, 20, 25, 30, 35, 40, 45, 45+5, 50, 55, 60, 65, 70, 75, 80, 85, 90, 90+5}

In Win-5 game, the sample space has five equally likely possible outcomes. Each possible outcome has a probability of 1/5, 0.2 or 20% chance. The athletic contest will produce a random variable that is going to match a correlated number in one of the five possible outcomes. Suppose you are asked, "In which pocket will the first goal occur?" Since all possible outcomes are equally likely, you would also be undecided on a favorable choice. When you play the Win-5 game, it is possible to win, but not certain.

Win-10

The present invention provides a method to divide chance into ten possibilities. Win-10 game is a bet for four players to wager against each other. Each player must have an equal probability of winning, which is 10% chance. To provide each contestant an equal chance, we divide 100÷10=10, where 100, the dividend, is the total number of elements in the numeric field.

10, the divisor, is the total number of possible outcomes.

10, the quotient, is the number of elements in each prediction.

Then we use the arithmetic progression method. The following sequence is an AP with common difference 10.

1: {01, 11, 21, 31, 41, 51, 61, 71, 81, 90+1}
2: {02, 12, 22, 32, 42, 52, 62, 72, 82, 90+2}
3: {03, 13, 23, 33, 43, 53, 63, 73, 83, 90+3}
4: {04, 14, 24, 34, 44, 54, 64, 74, 84, 90+4}
5: {05, 15, 25, 35, 45, 55, 65, 75, 85, 90+5}
6: {06, 16, 26, 36, 45+1, 46, 56, 66, 76, 86}
7: {07, 17, 27, 37, 45+2, 47, 57, 67, 77, 87}
8: {08, 18, 28, 38, 45+3, 48, 58, 68, 78, 88}
9: {09, 19, 29, 39, 45+4, 49, 59, 69, 79, 89}
10: {10, 20, 30, 40, 45+5, 50, 60, 70, 80, 90}

In Win-10 game, the sample space has ten equally likely possible outcomes. Each possible outcome has a probability of 1/10, 0.1 or 10% chance. The athletic contest will produce a random variable that is going to match a correlated number in one of the ten possible outcomes. Suppose you are asked, "In which pocket will the first goal occur?" Since all possible outcomes are equally likely, you would also be undecided on a favorable choice. When you play the Win-10 game, it is possible to win, but not certain.

Win-20

The present invention provides a method to divide chance into twenty possibilities. Win-20 game is a bet for twenty players to wager against each other. Each player must have an equal probability of winning, which is 5% chance. To provide each contestant an equal chance, we divide 100÷20=5, where 100, the dividend, is the total number of elements in the numeric field.

20, the divisor, is the number of possible choices.

5, the quotient, is the number of elements in each choice.

Then we use the arithmetic progression method. The following sequence is an AP with common difference 20.

Cat: {03, 24, 42, 61, 83}
Monkey: {05, 26, 45 + 2, 63, 86}
Tiger: {14, 35, 51, 72, 90 + 4}
Pigeon: {20, 37, 45, 58, 76}
Lobster: {12, 33, 49, 70, 90 + 2}
Dog: {07, 28, 45 + 4, 65, 87}
Squirrel: {02, 23, 44, 60, 89}
Snake: {17, 38, 54, 57, 78}
Lion: {08, 29, 45 + 5, 66, 81}
Crab: {11, 32, 48, 69, 90 + 1}
Horse: {06, 27, 45 + 3, 64, 77}
Eagle: {18, 39, 55, 75, 79}
Duck: {01, 22, 43, 59, 88}
Rabbit: {09, 30, 41, 67, 82}
Cow: {19, 40, 53, 56, 85}
Dolphin: {16, 21, 46, 74, 80}
Fish: {04, 25, 45 + 1, 62, 84}
Turtle: {10, 31, 47, 68, 90}
Octopus: 15, 36, 52, 73, 90 + 5}
Elephant: {13, 34, 50, 71, 90 + 3}

In Win-20 game, the sample space has twenty equally likely possible outcomes. Each possible outcome has a probability of 1/20, 0.05 or 5% chance. The athletic contest will produce a random variable that is going to match a correlated number in one of the ten possible outcomes. Suppose you are asked, "In which pocket will the first goal occur?" Since all possible outcomes are equally likely, you would also be undecided on a favorable choice. When you play the Win-20 game, it is possible to win, but not certain.

Win-25

The present invention provides a method to divide chance into two possibilities. Win-25 game is a bet for twenty-five players to wager against each other. Each player must have an equal probability of winning, which is 4% chance. To provide each contestant an equal chance, we divide $$100 \div 25 = 4, \text{ where}$$

100, the dividend, is the total number of elements in the numeric field.

25, the divisor, is the number of possible choices.

4, the quotient, is the number of elements in each prediction.

Then we use the arithmetic progression method. The following sequence is an AP with common difference 25.

Cantaloupe: {05, 30, 67, 90 + 1}
Banana: {03, 28, 65, 90}
Mango: {14, 39, 51, 76}
Orange: {20, 45, 56, 81}
Tomato: {21, 45 + 1, 58, 83}
Apricot: {24, 45 + 4, 61, 86}
Cranberry: {10, 35, 47, 72}
Lime: {15, 40, 52, 77}
Cherry: {18, 43, 55, 80}
Plum: {23, 45 + 3, 60, 85}
Watermelon: {25, 45 + 5, 62, 87}
Avocado: {09, 34, 46, 71}
Pomegranate: {11, 36, 48, 73}
Coconut: {16, 41, 53, 78}
Pineapple: {07, 32, 69, 90 + 4}
Perch: {17, 42, 54, 79}
Tangerine: {04, 29, 66, 90 + 1}
Grapefruit: {08, 83, 70, 90 + 5}

-continued

Apple: {01, 26, 63, 88}
Mandarin: {12, 37, 49, 74}
Pear: {06, 31, 68, 90 + 3}
Grape: {19, 44, 56, 81}
Passion Fruit: {02, 27, 64, 89}
Nectarine: {22, 45 + 2, 59, 84}
Strawberry: {13, 38, 50, 75}

In Win-25 game, the sample space has twenty-five equally likely possible outcomes. Each possible outcome has a probability of 1/25, 0.04 or 4% chance. The athletic contest will produce a random variable that is going to match a correlated number in one of the twenty-five possible outcomes. Suppose you are asked, "In which pocket will the first goal occur?" Since all possible outcomes are equally likely, you would also be undecided on a favorable choice. When you play the Win-25 game, it is possible to win, but not certain.

The Outcome Must be a Random Draw—

A bet can be fair without being honest. The present invention provides a method to convert a soccer match into a random number generator. In order to generate a random outcome from a soccer match, we combine the last goal with the minute the ball crosses the goal line. Then the athletic contest will produce a random variable, which the minute of the last goal. The random variable is going to match a correlated number in one of several possible choices. Randomly and unpredictably occurred, the minute of the last goal is the sine qua non condition to win. In order for a participant to win, a number in his prediction must match the random outcome. By making "the minute of the last goal" the factor, we allow chance to determine the winner. Just like a coin toss, a roll of a die or a spinning wheel; much of what happens in the game follows the rules of chance. This technique converts a soccer match into a random number generator. The random outcome is what makes a prediction true or false. A player win, if a number in his selection matches the random outcome. Otherwise, he loses. The Ultimate Goal game is fair because each participant have an equal chance of winning and the winner is selected at random.

Is the Process Random? In probability, an experiment is any process that can be repeated in which the results are uncertain. To call a process "random," certain conditions apply. First, the process must obey the mathematical requirements of probability of sampling.

1. Every participant must have an equal chance of winning.
   Example, all possible outcomes are equally likely.
2. The outcome must be the result of a random draw.
   Example, the athletic contest will produce a random variable that is going to match a correlated number in any of the possible choices. The player who matches the random variable is the winner.

Second, each derived outcome must satisfy probability axioms.

1. According to axiom 1, the probability of an event must a number between zero and one.
   Example, the following are the probabilities found in Ultimate Goal games and they are all greater than zero and less than one. 0 1/25, 1/20, 1/10, 1/5, 1/4, 1/2 1.
2. According to axiom 2, the sum of probabilities must be equal to one.

Example, Player A and Player B are playing against each other. The probability of winning for each player is exactly 0.5; then the sum of probabilities is $0.5+0.5=\Omega=1$.

3. Axiom 3 does not apply to the invention.
4. Axiom 4 is a formula for players to calculate the probability that an event will not occur.
5. Axiom 5—Two events A and B are independent if the occurrence of one does not change the probability that the other occurs.

Example, in the 2018 World Cup final, despites a group of "Researchers in economics at the University of Rennes 1 and the CREM established at 70.63% the chances of victory for France, against 29.37% for Croatia;" this probability has had no influence on the probability of the prognostic contest. The score of the match, 4 goals to 2 has been the result of the athletic contest. The last goal occurred at 69 minute of the game, 69 has been the outcome of the prognostic contest. The result of the athletic contest and the outcome of the prognostic contest are two independent events. Even if a team has 99.99% chance of victory, the probability of either team to win cannot influence the probability of the prognostic contest.

The present invention is designed to be implemented in a computer system to allow players from around the world to play. Devices such as cellular phone, television set top box, smart television, personal computers, lap top, tablet and game console can be used to enable communication between players and the server computer. When a player wants to gain access to one of the games, the server computer will receive an incoming message from the player's device. In the case of a new player, to access the information, he must register or create an account and make a minimum deposit. Once the account is created and a minimum $10 is deposited, the new player can scroll through all the games. The player name and password are stored in the memory for use by the account manager during the session. The player information is also stored on the hard drive in the database. In the case of a player that already has an account, to access the information, he only needs to log in or identify himself by providing his "user name" and matching "password".

Referring to FIG. 1, which depicts the Win-2 bet. The Win-2 is a prognostic contest that has only two equal choices for two contestants to compete one against another. To play the Win-2 bet, players are required to select an athletic competition by clicking on the drop down menu located in the dialog box 2. Once an athletic contest is selected, bettors must click on the amount of money 4 they wish to bet. In the field 6, players are required to pick either Odd or Even pocket. Then, the ok button 8 allows contestants to either validate the transaction or let the server computer do it automatically after a 5-second countdown. The cancel button 10 allows contestants to cancel the transaction before the end of a 5-second countdown.

Figure 2:
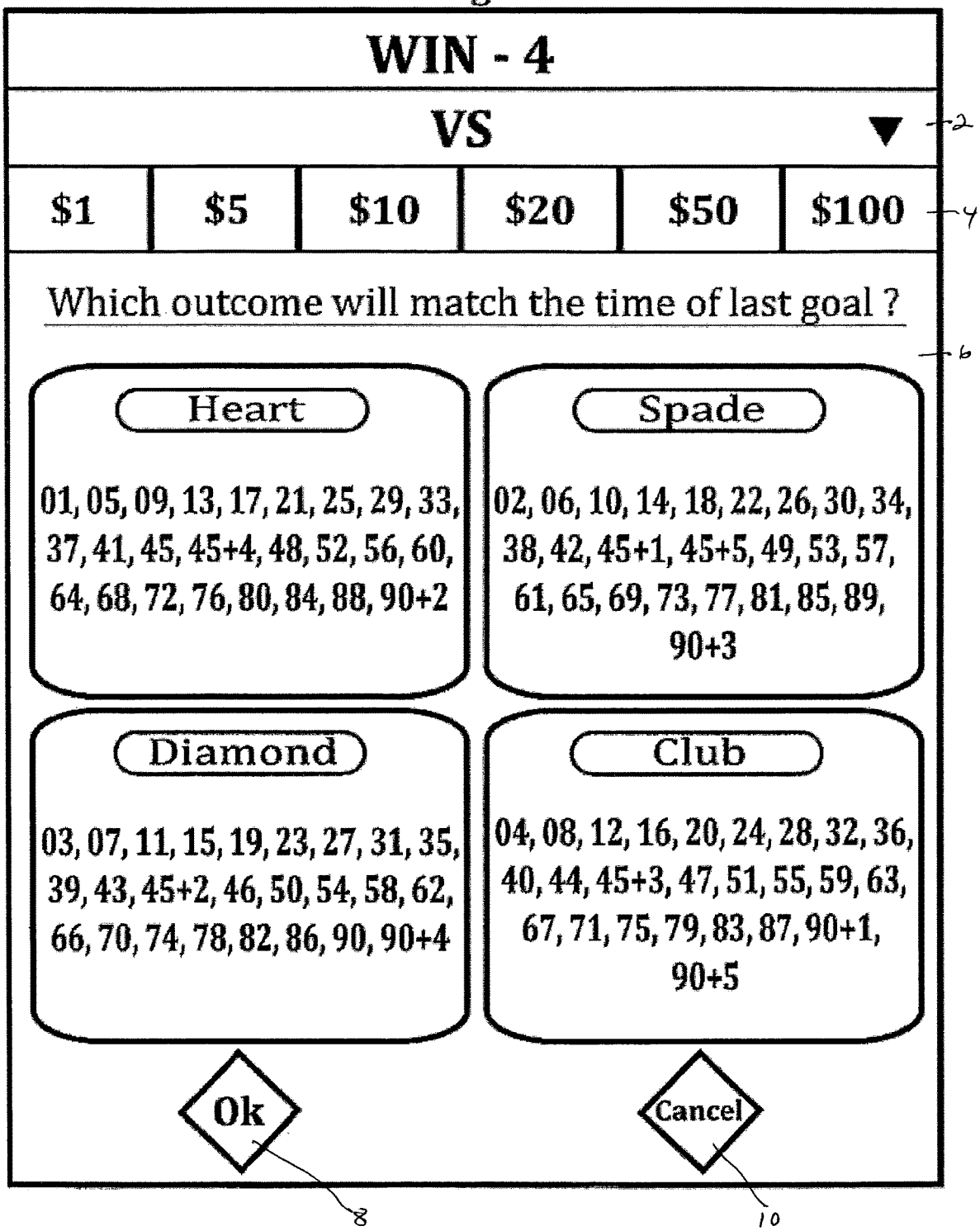
FIG. 2 is an illustration of Win-4 bet, a wager that has four equally likely possible outcomes for 4 contestants to play against each other, as it would be viewed and used by the participants accordingly to the embodiment of the present invention.

Referring to FIG. 2, which depicts the Win-4 bet. The Win-4 is a prognostic contest that has four equal choices for four contestants to compete one against another. To play the Win-4 bet, players are required to select a soccer match by clicking on the drop down menu located in the dialog box 2. Once an athletic contest is selected, bettors must click on the amount of money 4 they wish to bet. In the field 6, players are required to select one of the four possible choices. Then, the ok button 8 allows contestants to either validate the transaction or let the server computer do it after a 5-second countdown. The cancel button 10 allows contestants to cancel the transaction before the end of a 5-second countdown.

Figure 3:
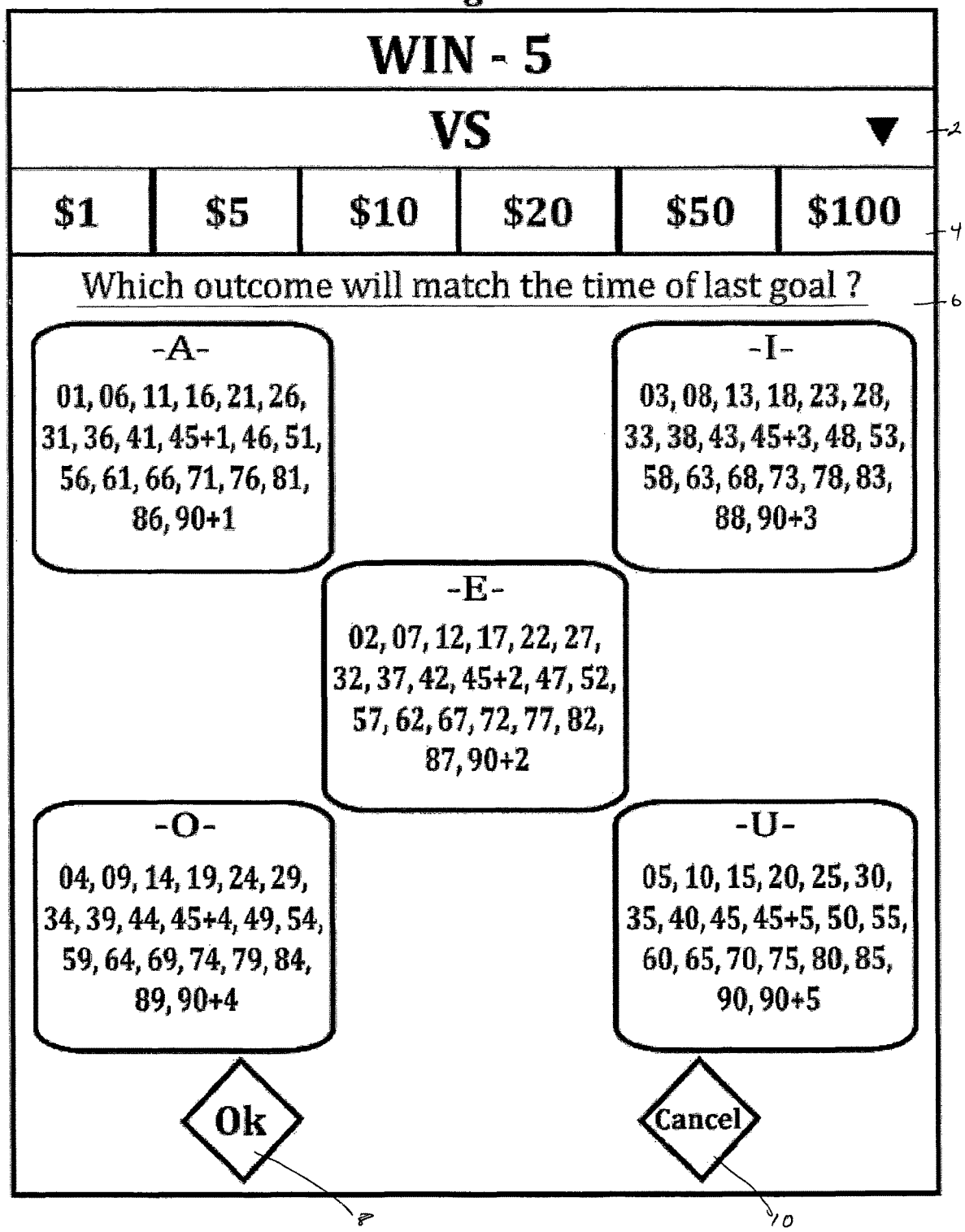
FIG. 3 is an illustration of Win-5 bet, a wager that has five equally likely possible outcomes for 5 contestants to play against each other, as it would be viewed and used by the participants accordingly to the embodiment of the present invention.

Referring to FIG. 3, which depicts the Win-5 bet. The Win-5 bet is a prognostic contest that has five equal choices for 5 contestants to compete one against another. To play the Win-5 bet, players are required to select a soccer match by clicking on the drop down menu located in the dialog box 2. Once a sporting event is selected, bettors must click on the amount of money 4 they want to bet. In the field 6, players are required to select one of the five combinations. Then, the ok button 8 allows contestants to either validate the transaction or let the server computer do it after a 5-second countdown. The cancel button 10 allows contestants to cancel the transaction before the end of a 5-second countdown.

Figure 4:
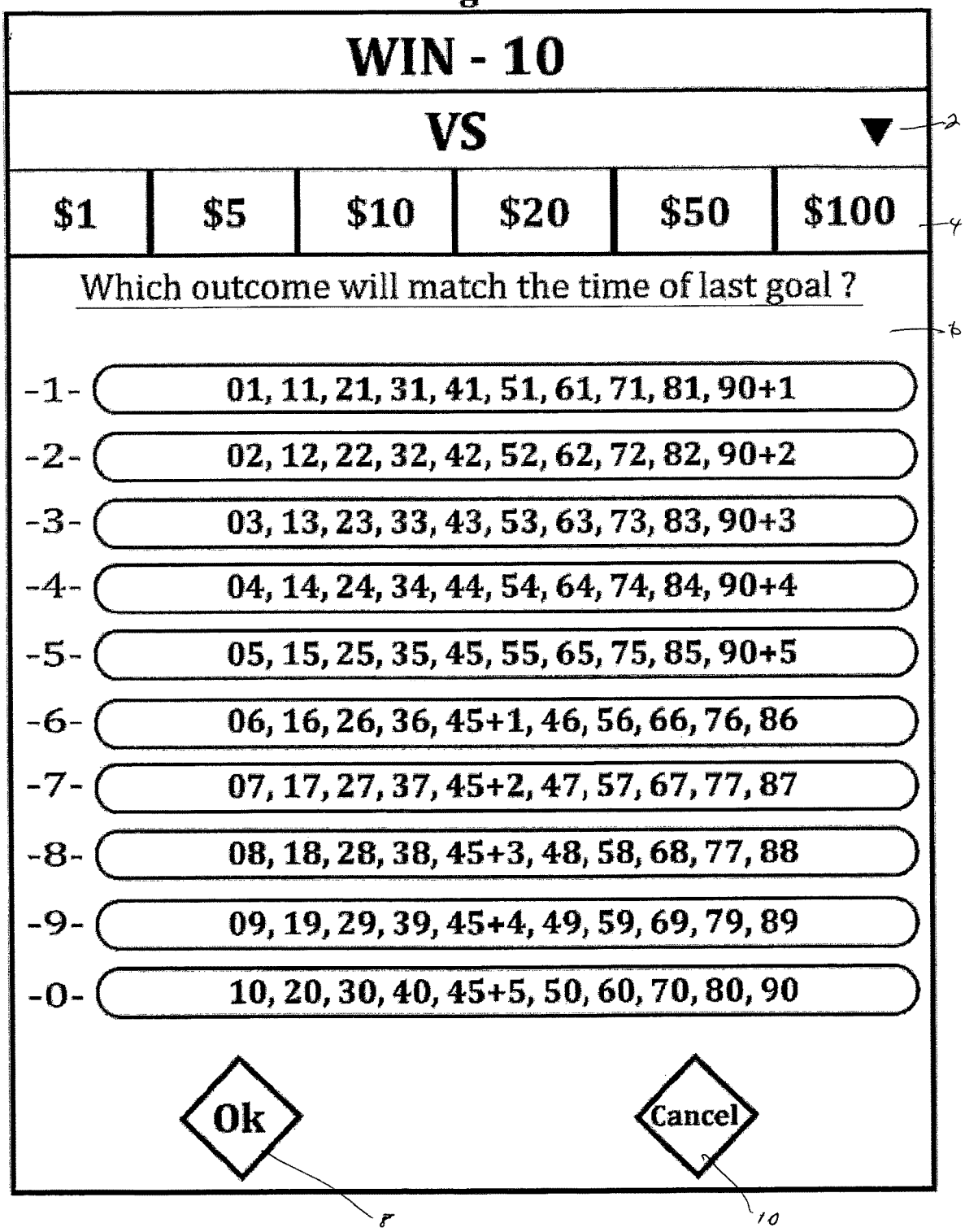
FIG. 4 is an illustration of Win-10 bet, a wager has ten equally likely possible outcomes for 10 contestants play against each other, as it would be viewed and used by the participants accordingly to the embodiment of the present invention.

Referring to FIG. 4, which depicts the Win-10 bet. The Win-10 bet is a prognostic contest that has ten equal choices for 10 contestants to compete one against another. To play the Win-10 bet, players are required to select a soccer match by clicking on the drop down menu located in the dialog box 2. Once a sporting event is selected, bettors must click on the amount of money 4 they want to bet. In the field 6, players are required to select one of the 10 possibilities. Then, the ok button 8 allows contestants to either validate the transaction or let the server computer do it after a 5-second countdown. The cancel button 10 allows contestants to cancel the transaction before the end of a 5-second countdown.

Figure 5:
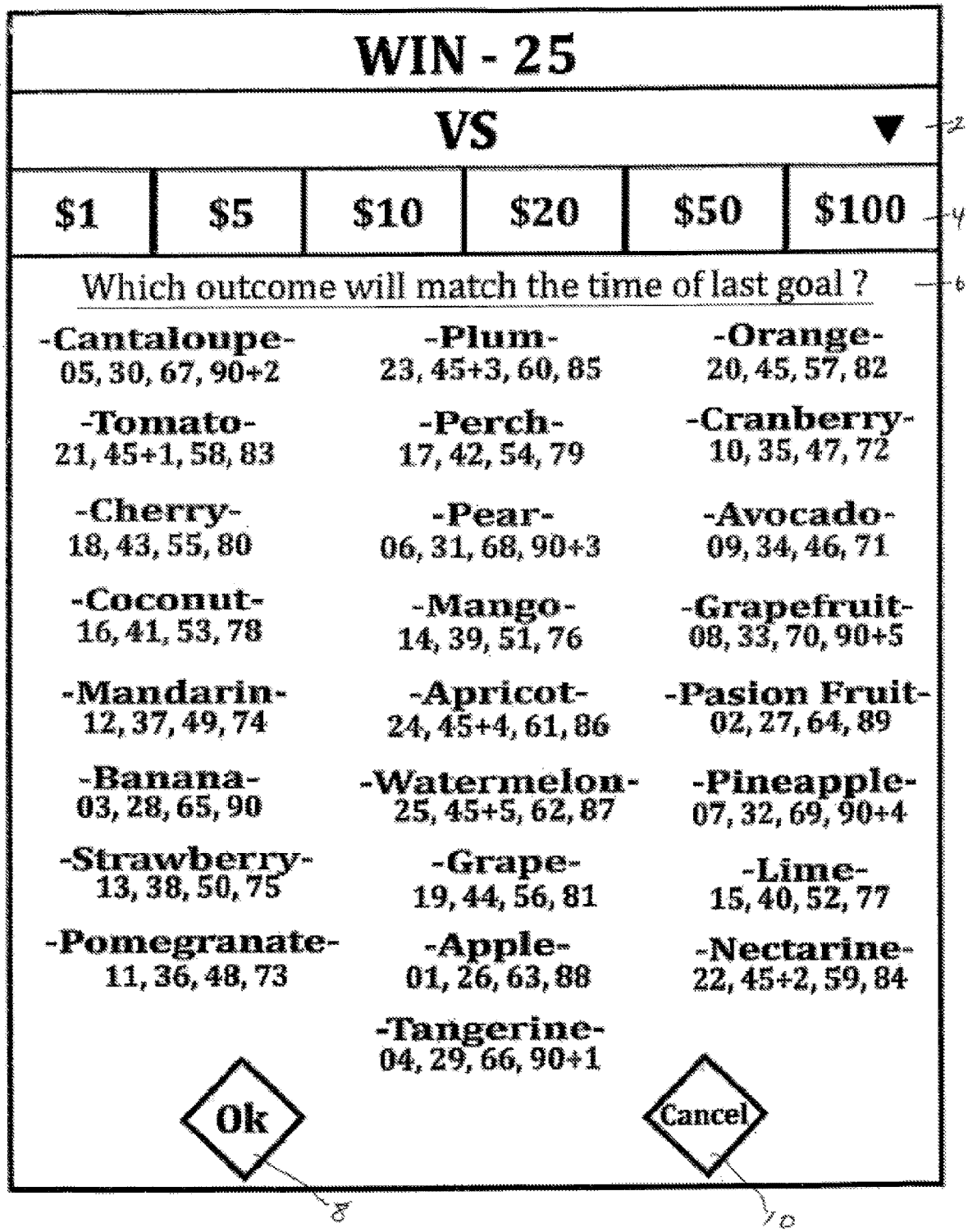
FIG. 5 is an illustration of Win-20 bet, a wager that has twenty equally likely possible outcomes for 20 contestants to play against each other, as it would be viewed and used by the participants accordingly to the embodiment of the present invention.

Referring to FIG. 5, which depicts the Win-20 bet. The Win-20 bet is a prognostic contest that has twenty equal choices for 20 contestants to compete one against another. To play the Win-20 bet, players are required to select a soccer match by clicking on the drop down menu located in the dialog box 2. Once a sporting event is selected, bettors must click on the amount of money 4 they want to bet. In the field 6, players are required to select one of the 20 possibilities. Then, the ok button 8 allows contestants to either validate the transaction or let the server computer do it after a 5-second countdown. The cancel button 10 allows contestants to cancel the transaction before the end of a 5-second countdown. As seen in FIGS. 1-5, the process can also be described to include displaying, on an electronic display apparatus for each of a plurality of users communicatively coupled to the computing database, a plurality of graphical elements each corresponding to one of the quotient betting sections with the temporal elements therein. Further, as also exemplified in FIGS. 1-5 and described above, the process can be described to include selecting, via user interaction with one of the plurality of graphical elements, a plurality of the temporal element selections from the plurality of users communicatively coupled to the computing database.

Figure 6:
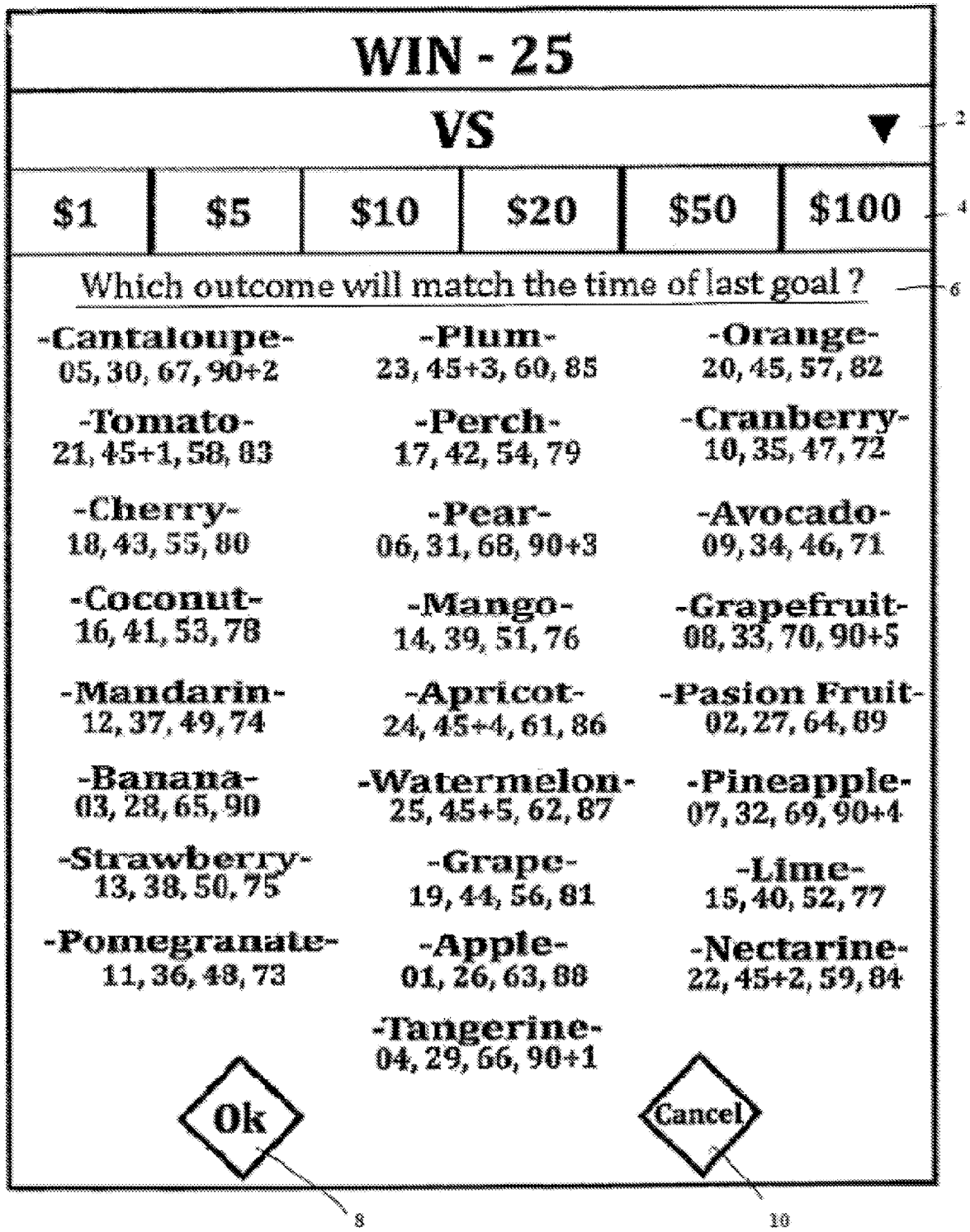
FIG. 6 is an illustration of Win-25 bet, a wager that has twenty-five equally likely possible outcomes for 25 contestants to play against each other, as it would be viewed and used by the participants accordingly to the embodiment of the present invention.

Referring to FIG. 6, which depicts the Win-25 bet. The Win-25 bet is a prognostic contest that has twenty-five equal choices for 25 contestants to compete one against another. To play the Win-25 bet, players are required to select a soccer match by clicking on the drop down menu located in the dialog box 2. Once a sporting event is selected, bettors must click on the amount of money 4 they want to bet. In the field 6, players are required to select one of the 25 choices. Then, the ok button 8 allows contestants to either validate the transaction or let the server computer do it after a 5-second countdown. The cancel button 10 allows contestants to cancel the transaction before the end of a 5-second countdown.

The present invention discloses a method to get the elements of the number field. A set of 100 elements, known as the universal set, which corresponds to the minutes of a soccer match, wherein the universal set is depicted below:

Ω

{01, 02, 03, 04, 05, 06, 07, 08, 09, 10,
11, 12, 13, 14, 15, 16, 17, 18, 19, 20,
21, 22, 23, 24, 25, 26, 27, 28, 29, 30,
31, 32, 33, 34, 35, 36, 37, 38, 39, 40,
41, 42, 43, 44, 45, 45+1, 45+2, 45+3, 45+4, 45+5
46, 47, 48, 49, 50, 51, 52, 53, 54, 55,
56, 57, 58, 59, 60, 61, 62, 63, 64, 65,
66, 67, 68, 69, 70, 71, 72, 73, 74, 75,
76, 77, 78, 79, 80, 81, 82, 83, 84, 85,
86, 87, 88, 89, 90, 90+1, 90+2, 90+3, 90+4, 90+5} a soccer match =Ω=element

Further, the present invention discloses a method for generating equally likely possible outcomes, with fixed probabilities; it provides six odds (2, 4, 5, 10, 20 and 25), which allow bettors to maximize their potential payouts by choosing the odds that lead to their best interest; it also allow bettors to maximize their chance of winning by choosing one of the following probabilities:

a) A method that divides a soccer match into two equally likely possible outcomes, with 50-element each; it provides a binary wager with a fixed probability of 50% chance of winning, where two players can bet one against another; the payout is 2 to 1, which means the winner will receive $2 for every dollar bet;

b) A method that divides a soccer match into four equally likely possible outcomes, with 25-element each; it provides a wagering round with a fixed probability of 25% chance of winning, where four players can bet one against another; the payout is 4 to 1, which means the winner will receive $4 for every dollar bet;

c) A method that divides a soccer match into five equally likely possible outcomes, with 20-element each; it provides a wagering round with a fixed probability of 20% chance of winning, where five players can bet one against another; the payout is 5 to 1, which means the winner will receive $5 for every dollar bet;

d) A method that divides a soccer match into ten equally likely possible outcomes, with 10-element each; it provides a betting round with a fixed probability of 10% chance of winning, where ten players can bet one against another; the payout is 10 to 1, which means the winner will receive $10 for every dollar bet;

e) A method that divides a soccer match into twenty equally likely possible outcomes, with 5-element each; it provides a wagering round with a fixed probability of 5% chance of winning, where twenty players can bet one against another; the payout is 20 to 1, which means the winner will receive $20 for every dollar bet;

f) A method that divides a soccer match into twenty-five equally likely possible outcomes, with 4-element each; it provides a betting round with a fixed probability of 4% chance of winning, where twenty-five players can bet one against another; the payout is 25 to 1, which means the winner will receive $25 for every dollar bet.

As such, the present invention beneficially provides increase in the public trust in the authenticity of both sport results and betting outcomes and features bigger payout, offers odds' choice, and makes sport betting a no-brainer, safeguards the integrity of sport, provide more betting options, allow bettors to choose their odds, allow bettors to quantify the chance of winning, pay all bets at true odds, and allow bettors to measure the potential payout. For example, see the below table:

Table of Games

| Games | Probability | Odds | Payouts |
|---|---|---|---|
| Win-2 | 50% | 1:1 | 2× |
| Win-4 | 25% | 1:3 | 4× |
| Win-5 | 20% | 1:4 | 5× |
| Win-10 | 10% | 1:9 | 10× |
| Win-20 | 5% | 1:19 | 20× |
| Win-25 | 4% | 1:24 | 25× |
| Win-33 | 3% | 1:32 | 33× |

Further, the present invention protects the integrity of casinos have a guaranteed 13% commission on all transactions made by individuals. Casinos no longer need the service of odds makers who provide subjective odds for individuals to wager. Casinos no longer gamble alongside with gamblers. Further, a sports book may offer two equally attractive betting options in an attempt to ensure that patrons bet equal amounts of money on both side of the wager. If the total amount of money wagered on each possible outcome is the same, the book will make a profit from the commission. The balance of equal amounts of money wagered on all possibilities determines the profit of the casino. If the amount of money played on each possibility is different, the casino risks seeing its profit decrease or even disappear.

For example, based on Win-2 game, the total amount of money played on odd pocket is $75,000 while the total amount wagered on even pocket is $90,000. Thus, there is a discrepancy of $15,000 (90,000-75,000) and the total commission generated by Win-2 game is $24,750, which is 13%. If the random outcome matches a number in odd pocket, this would increase the commission and the casino would have $39, 750 ($15, 000+$24, 750). If the random outcome matches a number in even pocket, this would decrease the commission and the casino would have only $9, 750 ($24, 750−15,000). If the total amount of money played on Win-2 is balanced, the casino would not take no risk and the commission would be $19, 500, which is 13% on $150, 000. In the gaming industry, the casino and the state control the integrity of the slot machines, bingo or poker. In sports gaming industry, although they cannot control the integrity of a soccer match that determines a winning or losing bet, the wagering establishment is responsible for paying the winning wagers.

The objective in the Ultimate Goal is to select a prediction and bet it will match the minute of the last goal. The Ultimate Goal has an array of six games. The most simple is the Win-2 contest, in which two participants wager against each other and the individual who matches the minute of the last goal wins.

The claims of the invention are:

1. An algorithmic-based gaming method implemented through a computing system for a soccer match and configured to transform sport gaming temporal elements into divided quotient betting sections generating a user winning outcome comprising:

generating, with a computer processor, a finite set of 100 temporal elements corresponding to minutes of a prospective soccer match and consisting of:

{01, 02, 03, 04, 05, 06, 07, 08, 09, 10,
11, 12, 13, 14, 15, 16, 17, 18, 19, 20,
21, 22, 23, 24, 25, 26, 27, 28, 29, 30,
31, 32, 33, 34, 35, 36, 37, 38, 39, 40,
41, 42, 43, 44, 45, 45+1, 45+2, 45+3, 45+4, 45+5
46, 47, 48, 49, 50, 51, 52, 53, 54, 55,
56, 57, 58, 59, 60, 61, 62, 63, 64, 65, 66, 67, 68, 69, 70, 71, 72, 73, 74, 75,
76, 77, 78, 79, 80, 81, 82, 83, 84, 85,
86, 87, 88, 89, 90, 90+1, 90+2, 90+3, 90+4, 90+5} dividing the finite set of 100 temporal elements into divided and equal quotient betting sections each uniquely including at least one of the 100 temporal elements, the equal quotient betting sections corresponding to a user winning outcome;

displaying, on an electronic display apparatus for each of a plurality of users communicatively coupled to the computing database, a plurality of graphical elements each corresponding to one of the quotient betting sections with the temporal elements therein;

selecting, via user interaction with one of the plurality of graphical elements, a plurality of the temporal element selections from the plurality of users communicatively coupled to the computing database;

receiving and storing on a computing database, the plurality of temporal element selections from the plurality of users communicatively coupled to the computing database, respectively, the plurality of temporal element selections each corresponding to one of the 100 temporal elements within one of the quotient betting sections; and producing a random winning outcome from the occurrence of the prospective soccer match, the random winning outcome corresponding to a last goal scored in the occurrence of the prospective soccer match and the one of the plurality of temporal element selections received from the plurality of users and stored on the computing database.

2. The algorithmic-based gaming method according to claim 1, further comprising:

dividing the finite set of 100 temporal elements into divided and equal quotient betting sections using an arithmetic progression method.

* * * * *